US008857618B1

(12) United States Patent
Dennis

(10) Patent No.: US 8,857,618 B1
(45) Date of Patent: Oct. 14, 2014

(54) CHILD'S ACTIVITY STATION

(71) Applicant: George Dennis, Elkhorn, NE (US)

(72) Inventor: George Dennis, Elkhorn, NE (US)

( * ) Notice: Subject to any disclaimer, the term of this patent is extended or adjusted under 35 U.S.C. 154(b) by 156 days.

(21) Appl. No.: 13/712,115

(22) Filed: Dec. 12, 2012

(51) Int. Cl.
*B65D 69/00* (2006.01)
*A45C 15/00* (2006.01)

(52) U.S. Cl.
CPC ..... *A45C 15/00* (2013.01)
USPC ..... 206/579; 206/575

(58) Field of Classification Search
USPC ..... 206/575, 579, 541, 1.7, 1.8, 1.9; 220/17.1, 575, 603, 915.1
See application file for complete search history.

(56) References Cited

U.S. PATENT DOCUMENTS

| | | | | |
|---|---|---|---|---|
| 4,142,627 | A * | 3/1979 | Szegi | 206/1.7 |
| 5,257,721 | A * | 11/1993 | Smith et al. | 220/533 |
| D500,800 | S * | 1/2005 | Shamoon | D19/88 |
| 8,167,131 | B1 * | 5/2012 | Anderson | 206/575 |
| 2008/0099290 | A1 * | 5/2008 | Stern | 190/109 |

* cited by examiner

*Primary Examiner* — David Fidei
(74) *Attorney, Agent, or Firm* — Allan L. Harms; Shuttleworth & Ingersoll, PLC

(57) ABSTRACT

A child's portable travel station includes an enclosure with a handle, the enclosure having a lid hinged to a case and having a bean bag or other conformable member attached to the bottom of the case. A receptacle for a beverage container is open at the top surface of the lid and is supported on the floor of the case. An opening in the top surface opens into the beverage container. The top of the beverage container is generally flush with the top surface. The top surface provides a work surface for a child using the travel station. The enclosure includes an internal volume to hold toys, books, writing utensils and other possessions of the child.

17 Claims, 3 Drawing Sheets

CHILD'S ACTIVITY STATION

BACKGROUND

The present invention pertains to children's activities and particularly to a portable activity station for use by children during travel.

Travel for a child is particularly tedious when confined in a safety harness such as used in an automobile or plane. In order to provide activities for a child to perform to distract the child from the tedium of travel, parents have provided various game sets, traditional books, portable electronic devices, motion picture players, sound recording players as well as simple play surfaces. These devices may include pencils or other writing or drawing instruments, work papers such as coloring books, and playthings. With the increase in the dependency of persons to have a drink at hand while traveling, an activity station for a child's use would benefit from inclusion of a drink holder.

BRIEF SUMMARY OF THE INVENTION

An improved activity station for use by a child while traveling or required to stay in a seated position includes an enclosure of generally rectangular shape with a conformable undersurface which improves the stability on the lap of the using child. Such a conformable undersurface may be a flexible fabric enclosure filled with granular material, such as a bean bag, which has been attached to the bottom wall of the enclosure. A memory foam product may also suffice as the conformable undersurface. A flat top surface of the enclosure includes a receptacle for receiving a beverage container such as an aluminum can, a plastic bottle, or an open-topped cup. The receptacle extends from the floor of the inside of the enclosure and extends at least through an opening in the top surface of the enclosure. A paper retention clip may be fixed to the top surface to hold work papers for the child's use. The enclosure has a sufficiently large interior to house small toys, small dolls, books, small portable electronic devices, pencils, markers, crayons, writing pens, as well as other possessions of a child of limited size which will fit within the enclosure. The enclosure includes a lower case and a shallow lid which is hinged to the case, and also includes one or more latches to securely lock the lid to the case when the lid is closed over the case. A handle having a first component attached to the lid and a second component attached to the case extends from the sidewall of the enclosure which is opposite the sidewall equipped with the hinge which connects the lid to the case. The depth of the receptacle is sufficient to assure that a beverage container will be prevented from rocking excessively in the receptacle so that spills of the contents of the beverage container are minimized.

It is a primary object of the invention to provide an activity station for a child which houses articles for use by the child and which provides a secure beverage container receptacle that is minimally susceptible to tipping of the beverage container within the receptacle.

It is a further object of the invention to provide a child's play station for travel use which includes a flat work surface, an enclosure for storage and transport of activity items and a conformable under surface which permits the under surface to conform to the shape of a using child's lap.

It is a further object of the invention to provide a child's activity station which may be comfortably carried without risk of separation of the lid from the case of the enclosure.

These and other desirable objects of the invention will be apparent from review of the drawings, and the detailed description which follows.

DETAILED DESCRIPTION

Figure 1:
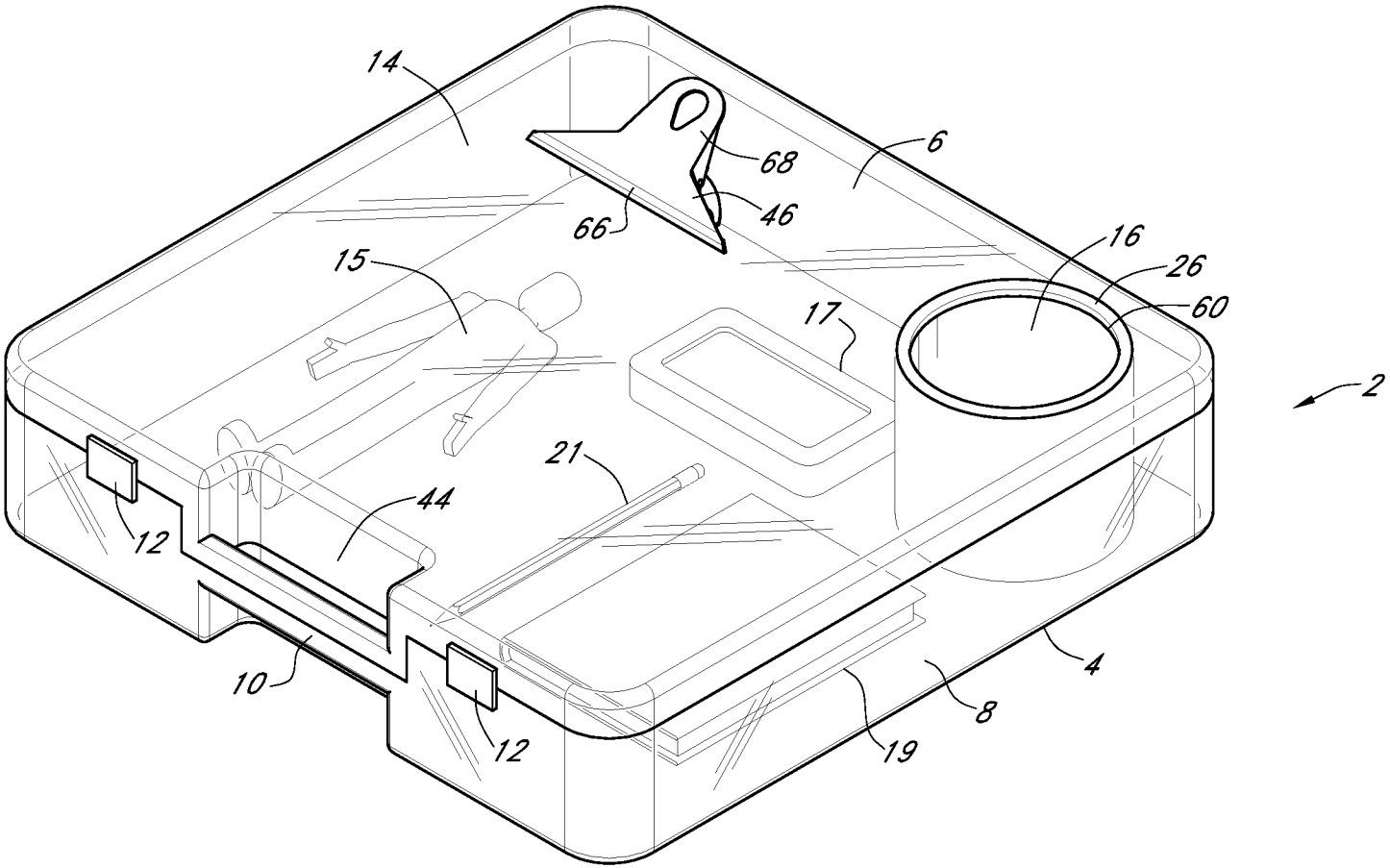
FIG. 1 is a top right perspective view of the activity station according to the invention.
Figure 2:
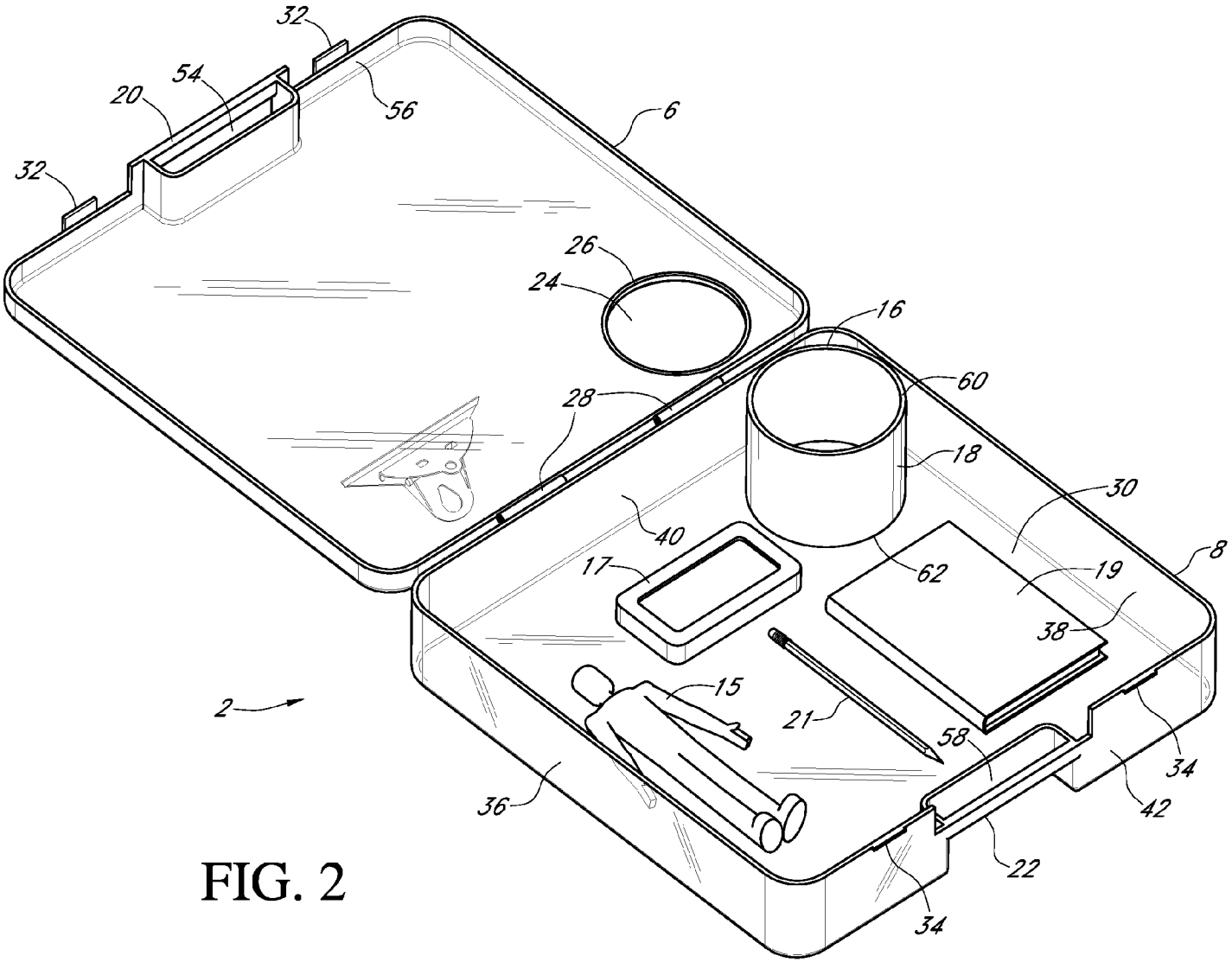
FIG. 2 is a top left perspective of the activity station of FIG. 1 with the lid in an open position exposing the interior of the case to which the lid attaches.
Figure 3:
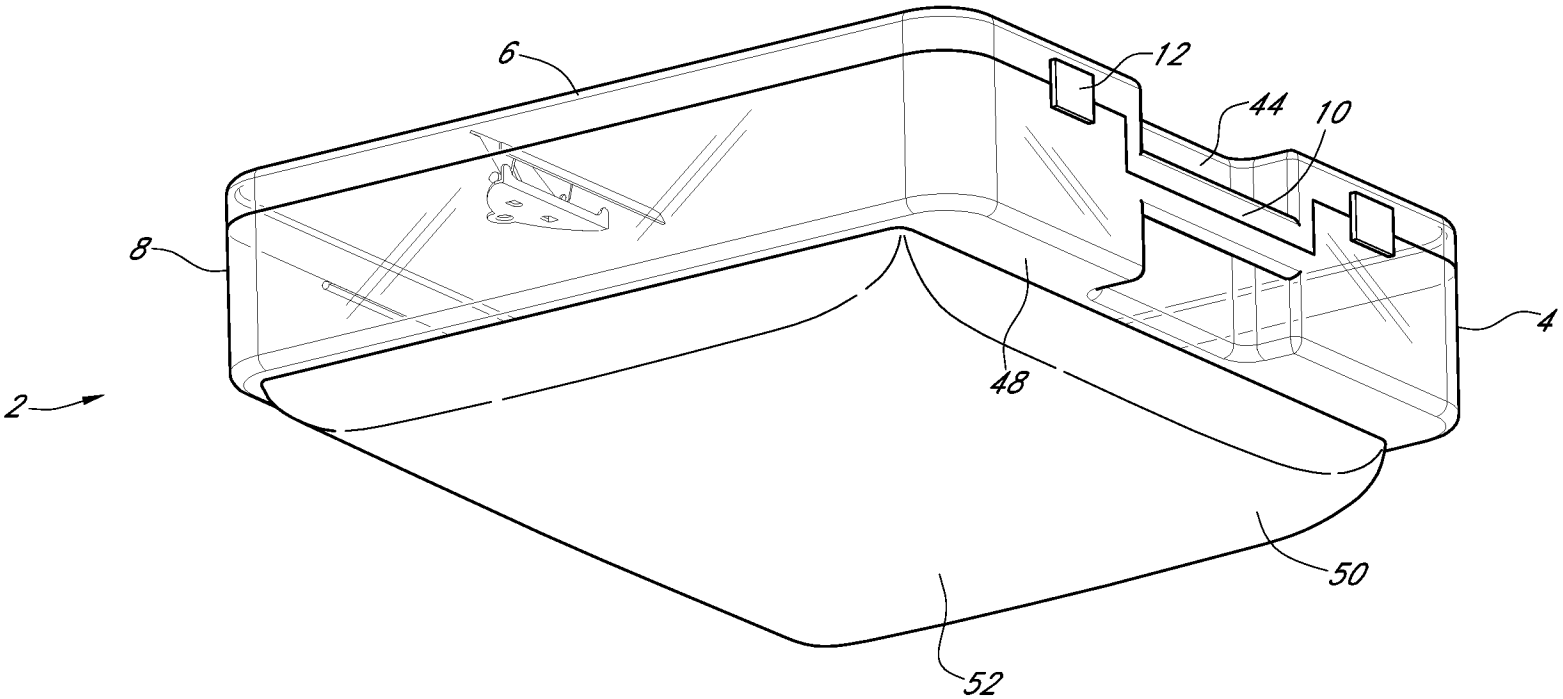
FIG. 3 is a bottom left perspective of the activity station of FIG. 1 illustrating the conformable undersurface of the activity station.

A child's activity station is illustrated in FIGS. 1-3. FIG. 1 discloses that the activity station 2 comprises an enclosure 4 which may be substantially rectangular in shape and which comprises a lid 6 hinged to a case 8. A conformable element 50 such as a flexible fabric bag filled with beans or other granular material is fixed to the bottom 48 of case 8 of enclosure 4. Conformable element 50 may alternatively be constructed of a foam material which temporarily conforms to the surface with which it abuts while in abutment. Conformable element 50 permits a child or other user to place the activity station 2 on his or her lap with the conformable element 50 conforming its underside 52 to the contours of the using child's lap area. If desired, the activity station 2 may be placed on another support and the underside 52 will conform to the topography of the support.

When closed upon case 8, lid 6 is retained thereto by latch elements 12. A handle 10 is provided on enclosure 4 for carrying of the activity station 2. Enclosure 4 includes an internal volume for storing and transporting objects to be used by the child.

Lid 6 provides a planar top surface 14 on which the using child may work with his or her activities, such as writing, drawing, or playing with toys. Enclosure 4 also comprises a receptacle 16 which is open at its top 60, the top 60 being generally flush with or protruding only slightly through the top surface 14 and providing a well space for receiving beverage containers, pencils or other items. A grommet 26 surrounds the top 60 of receptacle 16 to bridge any gaps which might exist between the opening 24 and the sidewall 18 of receptacle 16. Grommet 26 is adhered to opening 24 to cushion the periphery of opening 24 in the thin-walled lid 6. See also FIGS. 2-3.

Top surface 14 further comprises a retention clip 46 which may be used to secure work papers to the top surface 14 so that the using child may write upon such work papers without their sliding around on the top surface 14. An exemplary spring loaded clip 16 is illustrated having a blade 66 and a lever 68 for raising the blade 66 above the top surface 14. Clip 16 may be fixed to top surface 14 by adhesive or mechanical fastenings or it may be formed as part of lid 6.

FIG. 1-3 show that the lid 6 is non-opaque and preferably translucent such that a using child may observe generally the contents within enclosure 4 before opening the lid 6. The sidewalls 36, 38, 40, 42 of case 8 likewise may be translucent such that the contents of the enclosure 4 may be seen from other vantage points. In practice, enclosure 4 may be made entirely of translucent material.

As examples of the items which may be stored and transported within enclosure 4, the figures show a small doll 15, a portable electronic device 17, a book 19 and a pencil 21.

These are merely exemplary and any item small enough to fit within the case 8 may be stored and transported within enclosure 4.

Referring particularly to FIG. 2, the enclosure 4 is shown in an open position with lid 6 delatched from case 8 and rotated about hinges 28 so that lid 6 and case 8 are positioned in a side-by-side open configuration. It can now be better observed that lid 6 comprises an opening 24 therethrough, the opening 24 being aligned with the top opening 60 of receptacle 16 when lid 6 is closed over case 8 and latched thereto. Grommet 24 is fitted to the inner diameter of opening 24.

Receptacle 16 is seen to include a cylindrical sidewall 18 which is bounded by the open top 60 and bottom 62 which is fixed to floor 30 of case 8. Preferably receptacle 16 is positioned near a corner of the enclosure 4, and spaced away from latch wall 42 so that a beverage container placed in receptacle 16 when the enclosure 4 is closed will not interfere with activities carried on atop top surface 14. Sidewall 18 may be adhered to floor 38 by adhesive, or it may be formed integrally with case 8. Of course, the opening 24 in lid 6 must be located such that it will encircle top opening 60 of receptacle 16 when lid 6 is closed onto case 8. It is important for the receptacle 16 to be supported on the floor 30 of case 8 to provide adequate depth for receptacle 16 such that beverage containers placed in receptacle 16 will not easily tip from the receptacle 16.

An exemplary enclosure 4 may be approximately 2.5-3.5 inches high with the lid 6 and case 8 each approximating 10-15 inches square. The depth of lid 6 may be about 0.5-1.0 inches and the depth of case 8 may be 2.0-2.5 inches. Larger and smaller dimensions are also contemplated though it is important that the enclosure 4 have sufficient interior depth to accept play items such as small toys, dolls, pencils, crayons, books, and small snack food items. This list of possible carried items is not intended to be exhaustive. It is also important that the area of top surface 14 be sufficient to permit a child user to draw or write on paper supported on the top surface 14.

The travel station 2 of FIGS. 1-2 include latches 12 which comprise catches 34 on front sidewall 42 of case 8 and aligned lever elements 32 on lid 6. It is intended that latches 12 allow secure connection of the lid 6 to case 8 when desired, but also allow a child to disconnect the lever elements 32 from catches 34 without adult intervention so that the child user may open the enclosure 4 to retrieve items as desired.

Handle 10 comprises two elements which when lid 6 is secured to case 8 abut and create handle 10. A recess 44 is formed in enclosure 4 below handle 10 to permit the user to place his or her hand around the handle 10. Handle 10 comprises a first handle element 20 formed on or joined with lid 6 and a second handle element 22 formed on or joined with case 8. By constructing the enclosure 4 such that the handle 10 helps to retain the lid 6 to the case 8 provides greater assurance that the enclosure 4 will not fall open unexpectedly when carried.

By forming handle 10 in two parts with the first handle element 20 on the latch sidewall 56 of lid 6 and the second handle element 22 on the latch sidewall 42 of case 8, and with handle elements 20, 22 generally aligned with the latch walls 42, 56, the outer periphery of enclosure 4 defines a rectangular or square polygon when supported on its lid 6 or on the conformable element 52 while permitting the handle 10 conveniently to be used to carry the travel station 2 in a comfortable manner. Latch wall 42 of case 8 and latch wall 56 of lid 6 are formed to provide recess 44 below handle elements 22, 20.

Handle elements 20, 22 preferably are molded along with lid 6 and case 8 respectively, and are located on lid 6 and case 8 such that handle 10 is generally midway between top surface 14 and bottom 48 (see FIG. 3), thereby allowing handle 10 to be generally symmetrical on enclosure 4. Recesses 58 of case 8 and 54 of lid 6 are molded into latch walls 42, 56 such that when lid 6 is closed and overlying case 8, recess 44 is available to accept the fingers of a person carrying travel station 2 by its handle 10.

Throughout this specification and the claims which follow, the word "comprise" will be understood to be equivalent to the word "include" and is not intended to be interpreted as limiting to a specific embodiment or illustration or to the exclusion of other elements.

The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

While the present invention has been particularly shown and described with reference to exemplary embodiments thereof, it should be understood by those of ordinary skill in the art that various changes, substitutions and alterations can be made herein without departing from the spirit and scope of the invention as embodied by the appended claims and their equivalents.

What is claimed is:

1. An activity station for use by a child comprising
an enclosure comprising an open-topped case and a lid hinged to the case,
the case including an undersurface,
the lid comprising a top surface of the enclosure,
the top surface of the enclosure substantially planar,
a conformable element fixed to the undersurface of the case,
the conformable element conforming to a contour of a lap of the child while the child is in a sitting position,
the top surface including an opening into an open topped receptacle,
the receptacle having a lower end and an upper end,
the lower end of the receptacle supported on a floor of the case,
the receptacle including a sidewall extending from the floor at least to the top surface when the lid is in a closed position overlying the case,
the upper end of the receptacle detached from the lid.

2. The activity station of claim 1 wherein
the upper end of the receptacle is generally flush with the top surface when the lid is in the closed position.

3. The activity station of claim 1 wherein
the lower end of the receptacle is fixed to the floor of the case.

4. The activity station of claim 1 wherein
the enclosure includes at least one translucent wall.

5. The activity station of claim 1 wherein
the lid of the enclosure is non opaque.

6. The activity station of claim 1 wherein
the enclosure further includes plural sidewalls interconnecting the top wall to the bottom wall,
each of the lid and the sidewalls being non-opaque.

7. The activity station of claim 1 wherein
a clip member is fixed to the top surface,
the clip member urging a work piece against the top surface.

8. The activity station of claim 1 wherein
the conformable element is a fabric enclosure enclosing granular material of at least a first kind.

9. The activity station of claim 1 wherein
the upper end of the receptacle is generally flush with the top surface,
the lower end of the receptacle is fixed to the floor of the case,
the enclosure includes at least one translucent wall,
a clip member is fixed to the top surface,
the clip member urging a work piece against the top surface,
the conformable element is a fabric enclosure enclosing granular material of at least a first kind,
the fabric enclosure fastened to the bottom wall.

10. The activity station of claim 9 wherein
the lid includes a top wall including the top surface,
the enclosure further including four sidewalls interconnecting the top wall to the bottom wall,
each of the top wall and the sidewalls being non-opaque.

11. The activity station of claim 10 wherein
the lid is selectively retained to the case by at least one latch element when the lid is in the closed position.

12. The activity station of claim 1 further comprising
a handle,
the handle attached to a first sidewall,
the first sidewall opposing a second sidewall,
the second sidewall comprising at least one hinge thereon,
a recess formed in the first sidewall adjacent the handle,
wherein fingers of a user may be placed within the recess and around the handle.

13. The activity station of claim 12 wherein
the handle comprises a first handle element and a second handle element,
the first handle element attached to the lid,
the second handle element attached to the case,
the first handle element abutted to the second handle element when the lid is in the closed position on the case.

14. A portable activity station for use by a child comprising
a case and a lid hinged to the case,
the case and the lid defining an enclosure when the lid is in a closed position overlying the case,
means to selectively retain the lid to the case when the lid is in the closed position,
the case comprising an undersurface,
the enclosure comprising a top surface,
the top surface substantially planar,
the top surface including an opening therethrough,
an open topped receptacle disposed within the opening,
the receptacle having a lower end and an upper end,
the upper end of the receptacle open at the top surface,
the lower end of the receptacle supported on a floor of the case,
the upper end of the receptacle detached from the top surface.

15. The activity station of claim 14 further comprising
a conformable element fixed to the undersurface,
the conformable element substantially conforming to a lap of the child while the child is in a sitting position.

16. The activity station of claim 14 further comprising
a handle,
the handle attached to a first sidewall,
the first sidewall opposing a second sidewall,
the second sidewall comprising at least one hinge thereon,
a recess formed in the first sidewall between the handle and the sidewall.

17. The activity station of claim 14 further comprising
the means to selectively retain the lid to the case comprise a pair of latches,
each latch comprising a catch and a lever element,
the lever element of each latch fixed to the lid,
the catch of each latch fixed to the case,
the at least one hinge is a flexible hinge,
the lid and the case formed of a first material,
the flexible hinge formed integrally of the first material.

* * * * *